US008098022B2

(12) United States Patent
Krummel

(10) Patent No.: US 8,098,022 B2
(45) Date of Patent: Jan. 17, 2012

(54) CIRCUIT CONFIGURATION FOR OPERATING AT LEAST ONE DISCHARGE LAMP AND METHOD FOR GENERATING AN AUXILIARY VOLTAGE

(75) Inventor: Peter Krummel, Traunreut (DE)

(73) Assignee: OSRAM AG, Munich (DE)

( * ) Notice: Subject to any disclaimer, the term of this patent is extended or adjusted under 35 U.S.C. 154(b) by 272 days.

(21) Appl. No.: 12/596,989

(22) PCT Filed: Apr. 23, 2007

(86) PCT No.: PCT/EP2007/053954

§ 371 (c)(1),
(2), (4) Date: Oct. 22, 2009

(87) PCT Pub. No.: WO2008/128575

PCT Pub. Date: Oct. 30, 2008

(65) Prior Publication Data

US 2010/0148699 A1 Jun. 17, 2010

(51) Int. Cl.
*G05F 1/00* (2006.01)

(52) U.S. Cl. ..... 315/291; 315/307; 315/224; 315/247; 315/274

(58) Field of Classification Search ..... 315/247, 315/224, 225, 274–279, 291, 307–311
See application file for complete search history.

(56) References Cited

U.S. PATENT DOCUMENTS 6,731,078 B2 5/2004 Huber et al.
2006/0273737 A1 12/2006 Heckmann

FOREIGN PATENT DOCUMENTS

DE 102005041076 A1 3/2007
EP 0439240 B1 6/1995

(Continued)

OTHER PUBLICATIONS

English abstract of EP 0439240.

(Continued)

*Primary Examiner* — Tuyet Thi Vo

(57) ABSTRACT

A circuit arrangement for operating at least one discharge lamp may include: a first and a second input terminal for connecting a supply voltage; an inverter, which includes at least one first switch and one second switch, which are coupled in series between the first and the second input terminal and between which a bridge center point is defined; a drive circuit for at least the first switch and the second switch with an input for receiving a control signal; an apparatus for generating an auxiliary voltage. The apparatus may include: a first capacitor; a terminal for the provision of the auxiliary voltage, which terminal is coupled to a reference potential via the first capacitor; a two-state controller with a first input to which the control signal in inverted form is coupled, a second input, which is coupled to the terminal for the provision of the auxiliary voltage, and an output; a switch—with a control electrode, a working electrode and a reference electrode, the control electrode being coupled to the output of the two-state controller, the working electrode being coupled to the terminal for the provision of the auxiliary voltage; and a nonreactive resistor; wherein the apparatus for generating the auxiliary voltage furthermore includes a transformer with a primary winding and a secondary winding, the transformer being coupled to the first and the second input terminal, the terminal for the provision of the auxiliary voltage and the switch-in such a way that a current through the switch results in a current through the primary winding, in a current through the secondary winding and therefore in charging of the first capacitor.

10 Claims, 4 Drawing Sheets

FOREIGN PATENT DOCUMENTS

| | | | |
|---|---|---|---|
| EP | 1231821 | B1 | 8/2004 |
| EP | 1729546 | A1 | 12/2006 |
| WO | 2007025849 | A1 | 3/2007 |

OTHER PUBLICATIONS

International Search Report of PCT/EP2007/053954 mailed on Jan. 3, 2008.

CIRCUIT CONFIGURATION FOR OPERATING AT LEAST ONE DISCHARGE LAMP AND METHOD FOR GENERATING AN AUXILIARY VOLTAGE

RELATED APPLICATIONS

The present application is a national stage entry according to 35 U.S.C. §371 of PCT application No.: PCT/EP2007/053954 filed on Apr. 23, 2007.

BACKGROUND

The present invention relates to a circuit arrangement for operating at least one discharge lamp with a first and a second input terminal for connecting a supply voltage, an inverter, which comprises at least one first switch and one second switch, which are coupled in series between the first and the second input terminal and between which a bridge center point is defined, a drive circuit for at least the first switch and the second switch with an input for receiving a control signal, and an apparatus for generating an auxiliary voltage. In this case, the auxiliary voltage comprises a first capacitor, a terminal for the provision of the auxiliary voltage, which terminal is coupled to a reference potential via the first capacitor, a two-state controller with a first input to which the control signal in inverted form is coupled, a second input, which is coupled to the terminal for the provision of the auxiliary voltage, and an output, a switch with a control electrode, a working electrode and a reference electrode, the control electrode being coupled to the output of the two-state controller, the working electrode being coupled to the terminal for the provision of the auxiliary voltage, and a nonreactive resistor. The invention moreover relates to a method for generating an auxiliary voltage in such a circuit arrangement.

A circuit arrangement of the generic type which is known from the prior art is shown in FIG. 1 to illustrate the problem on which the invention is based. Said figure shows a segment of an electronic ballast which is generally connected to an AC voltage system via a filter circuit, a rectifier circuit and a PFC (power factor correction) circuit. Said segment is fed by the so-called intermediate circuit voltage $U_{ZW}$, which is stabilized by means of a capacitor $C_{UZW}$. The intermediate circuit voltage $U_{ZW}$ in this case feeds a half-bridge circuit, which comprises a first switch S1 and a second switch S2, and is generally of the order of magnitude of 320 V. The half-bridge center point HM is coupled, via a lamp inductor L, to a discharge lamp La, with which a starting capacitor $C_1$ is connected in parallel and which is coupled to a reference potential via a coupling capacitor $C_K$. The circuit arrangement has a controller 10, which can be driven digitally via an interface 12, for example in accordance with the DALI standard. In the standby operating mode, i.e. when the inverter is switched off, the controller 10 requires a current supply of approximately 2 mA, and during normal operation, i.e. when the inverter is in operation, a current supply of approximately 30 mA. An "on" signal at the interface 12 results in a half-bridge driver circuit 14 coming into operation and driving the switches S1 and S2 in accordance with a default entry.

The interface evaluation performed by the controller 10 must be ready for use at any time, even in the "off" state of the output circuit 16, which comprises the inverter with the switches S1 and S2, the lamp inductor L and the lamp La together with the circuit, in order to be able to receive and evaluate a new "on" command, for example. For this purpose, it is necessary to always supply a voltage to the controller 10 even in the "off" state. In order thus to keep the interface 12 always in the ready state, standby losses occur, which are generally undesirable.

The known solution derives the standby current required for the controller 10 via a nonreactive resistor $R_F$ and a two-state controller SSD, which is controlled via a switch $Q_{ISS}$, directly from the intermediate circuit voltage $U_{ZW}$. In this case, the control signal which is used for switching on the half-bridge driver 14 is supplied in inverted form to the two-state controller SSD, with the result that the two-state controller comes into operation when the half-bridge driver 14 is switched off. Thus, the controller 10 is no longer supplied with voltage via its operational supply circuit 18, with the operational supply circuit, by way of example, in this case comprising a capacitor C2 and two diodes D1 and D2, but via an auxiliary voltage $V_{CC}$ provided at a capacitor $C_{VCC}$. An input 20 of the two-state controller SSD is used for measuring the voltage $V_{CC}$. The current source ISS illustrated in FIG. 1 can be implemented by an integrated circuit, but in a very simplified form also by a nonreactive resistor. As shown in FIG. 1, the standby supply at the capacitor $C_{VCC}$ is only active when the output circuit has been switched off via the interface 12. The two-state controller SSD keeps the auxiliary voltage $V_{CC}$ across the current source ISS, which is connected to the switch $Q_{ISS}$, constant by virtue of it varying the duty ratio depending on the current consumption and the level of the intermediate circuit voltage $U_{ZW}$. The standby power loss in this solution is approximately 0.5 to 1 W. The two-state-controlled current source required is advantageously already integrated in the case of a few commercially available half-bridge drivers.

One disadvantage with this known solution is the still undesirably high power loss in the standby operating mode.

One further disadvantage of this known solution consists in the fact that additional auxiliary voltage generation is required for the normal "on" operating mode. In this case this is implemented by the operational supply circuit 18, which is based on the principle of deriving this voltage capacitively at a suitable point from the output circuit 16.

Another circuit arrangement (not illustrated) solves the problem of an additional auxiliary voltage supply for the normal "on" operating mode by virtue of the fact that the circuit arrangement comprises a step-down converter, which generates a controlled auxiliary voltage. It allows auxiliary voltage generation not only in the standby operating mode, but also in the normal "on" operating mode, with it being possible for standby power losses of from 0.3 to 0.8 W to be achieved. The disadvantage consists in the fact that such a circuit arrangement is comparatively expensive and requires a large number of components.

SUMMARY

Various embodiments provide a circuit arrangement of the generic type and a method of the generic type such that said circuit arrangement and method in principle make possible a reduced standby power loss using an inexpensive implementation.

This object is achieved by a circuit arrangement having the features of patent claim 1 and by a method having the features of patent claim 10.

Various embodiments are based on the knowledge that the standby power loss can be substantially reduced by the use of a transformer. In this case, the transformer is used as a forward converter, the primary winding being coupled to the switch $QT_{ss}$ in such a way that a current through the primary winding results in a change in the current through the secondary winding corresponding to the transformation ratio of the transformer, the secondary winding being coupled to the capacitor $C_{vcc}$ in such a way that a current through the secondary winding results in charging of the capacitor $C_{vcc}$. As a result of the use of a transformer, the current drawn from the intermediate circuit voltage $U_{zw}$ is reduced by a factor of the transformation ratio in comparison with the circuit illustrated in FIG. 1 without the transformer. The power drawn from the system therefore likewise decreases by a factor of the transformation ratio of the transformer. In the case of a typical transformation ratio of 10, a standby power loss of approximately 0.05 to 0.10 W can thus be achieved.

In a preferred embodiment, the primary winding and the nonreactive resistor are connected in series, and this series circuit is coupled between the reference electrode of the switch and the first input terminal. In this case, the apparatus for generating the auxiliary voltage furthermore comprises a first diode, which is connected in parallel with the series circuit comprising the primary winding and the nonreactive resistor and is arranged such that it enables freewheeling of the current through the primary winding, and a second diode, which is connected in series with the secondary winding, the series circuit comprising the secondary winding and the second diode being coupled between the reference potential and the terminal for the provision of the auxiliary voltage. Accordingly, the standby power loss can be markedly reduced by two additional diodes and a transformer alone. The first and the second diode are in this case preferably in the form of fast recovery diodes.

Preferably, a current source is coupled between the working electrode of the switch and the terminal for the provision of the auxiliary voltage. This is preferably implemented in a particularly inexpensive manner by a nonreactive resistor.

A further category of embodiments solves the second problem mentioned above in connection with the prior art: that is to say that it provides the advantage of making it possible not only to reduce the standby power loss but also to generate a permanent auxiliary voltage, i.e. an auxiliary voltage for supplying power to the controller even during normal operation of the output circuit. There is thus no need for the operational supply circuit discussed in the context of the prior art. These embodiments are characterized by the fact that the apparatus for generating an auxiliary voltage furthermore comprises a second capacitor with a first and a second terminal, said capacitor being coupled to the bridge center point and the primary winding in such a way that a capacitive displacement current can flow through the primary winding. Since the bridge center point changes its potential during normal operation continuously between ground and the intermediate circuit voltage, a current flow through the second capacitor can be generated and utilized for generating a current flow through the primary winding. Thus, by virtue of this embodiment, even during normal operation a current through the secondary winding can be generated and used for charging the capacitor $C_{VCC}$ and thus for providing an auxiliary voltage at the controller.

Preferably, in this case the first terminal of the second capacitor is coupled to the bridge center point, and the second terminal of the second capacitor is coupled to the reference electrode of the switch. The fact that the switch is coupled to the primary winding in such a way that a current through the switch generates a current through the primary winding ensures that a displacement current of the second capacitor results in a current through the primary winding.

In a further embodiment, the apparatus for generating an auxiliary voltage furthermore comprises a third diode, the primary winding being coupled to the first input terminal via the third diode, the third diode being arranged to allow a current flow from the first input terminal to the primary winding, the node between the primary winding and the third diode being coupled to the second terminal of the second capacitor.

Preferably, the apparatus for generating an auxiliary voltage furthermore comprises a third capacitor, which is connected in parallel with the nonreactive resistor. This makes it possible to set the time constant at which the second capacitor is charged and discharged and thus the duration of a current flow through the primary winding and therefore also through the secondary winding.

Finally, it is preferred if a zener diode is connected in parallel with the first capacitor. This makes it possible for the auxiliary voltage provided to be protected against overvoltage.

Further advantageous embodiments are described in the dependent claims. The preferred embodiments proposed with reference to the circuit arrangement according to the invention and the advantages and details thereof apply correspondingly, if appropriate, to the method according to the invention.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
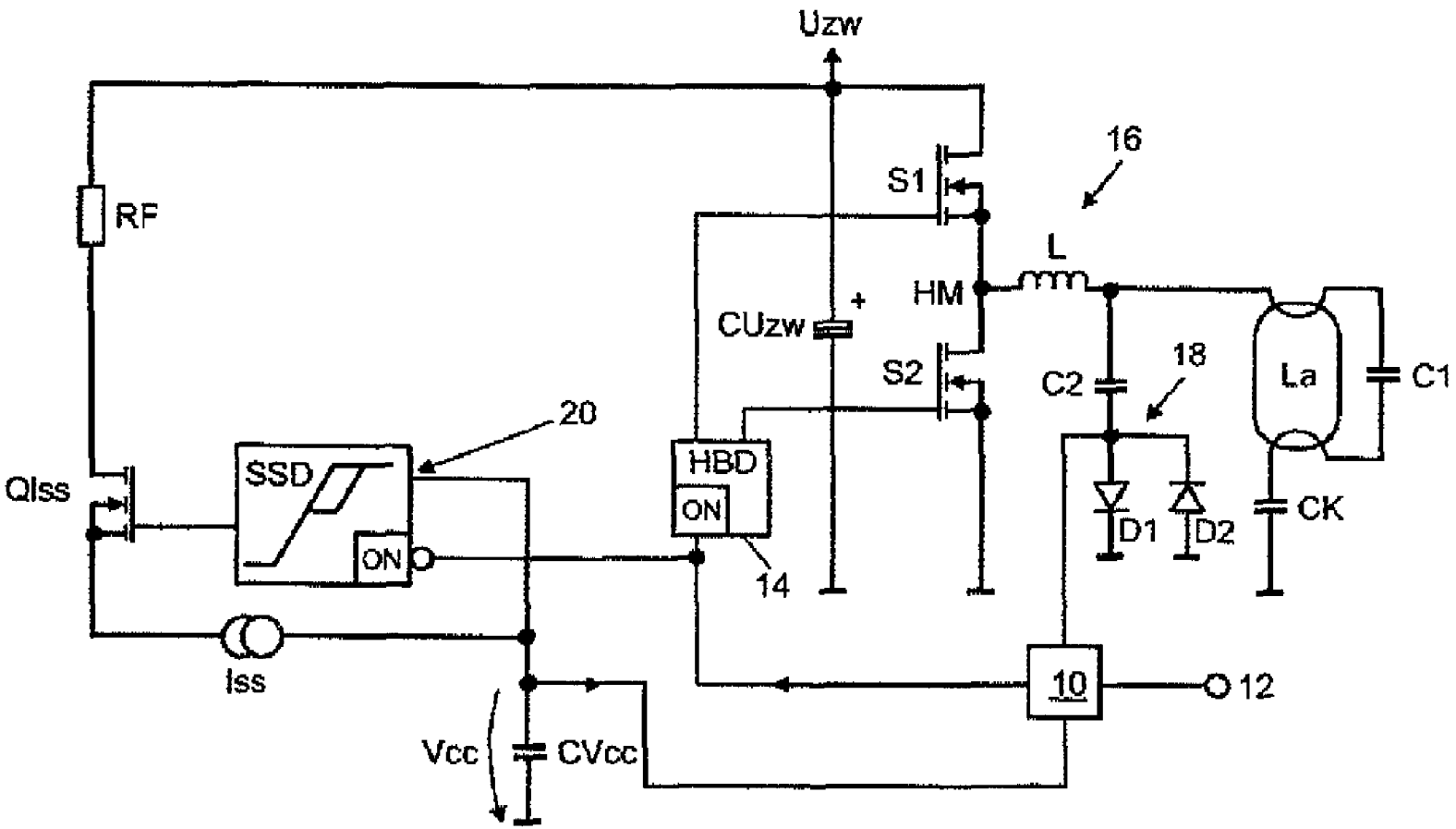
FIG 1 (Prior art)
FIG. 1 shows a schematic illustration of a circuit arrangement known from the prior art for operating at least one discharge lamp.
Figure 2:
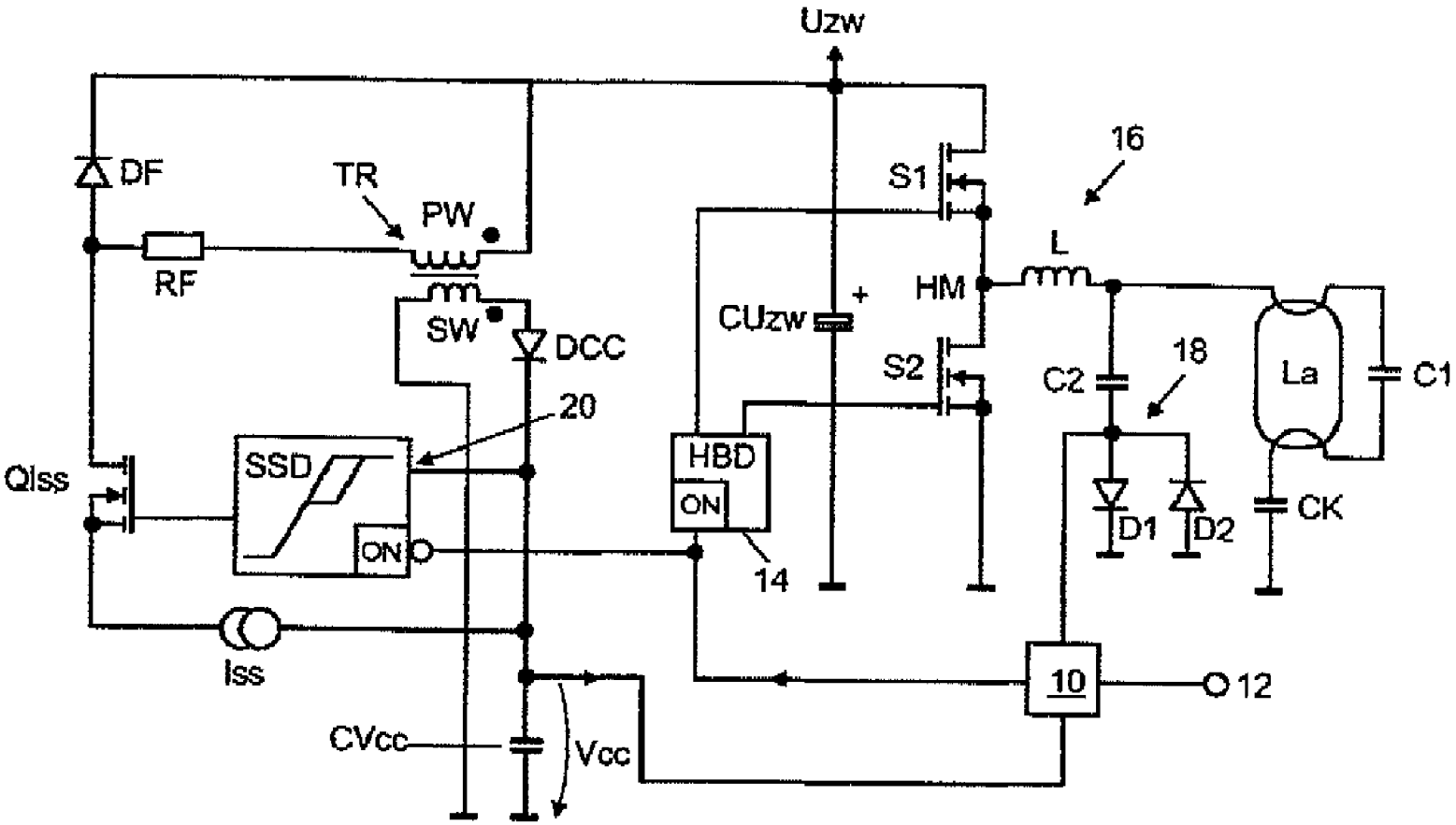
FIG. 2 shows a schematic illustration of a first exemplary embodiment of a circuit arrangement according to the invention for operating at least one discharge lamp.
Figure 3:
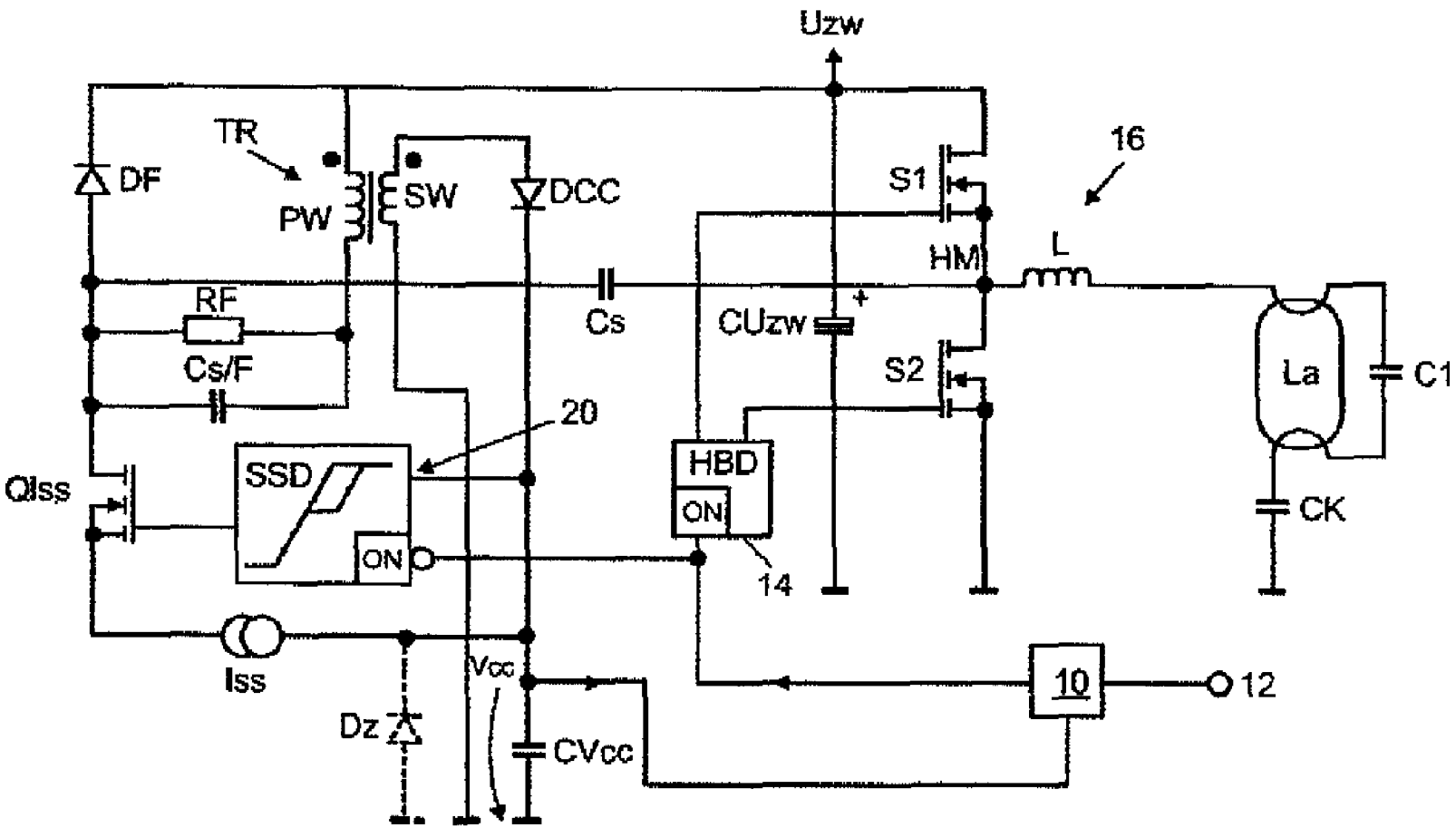
FIG. 3 shows a schematic illustration of a second exemplary embodiment of a circuit arrangement according to the invention for operating at least one discharge lamp.
Figure 4:
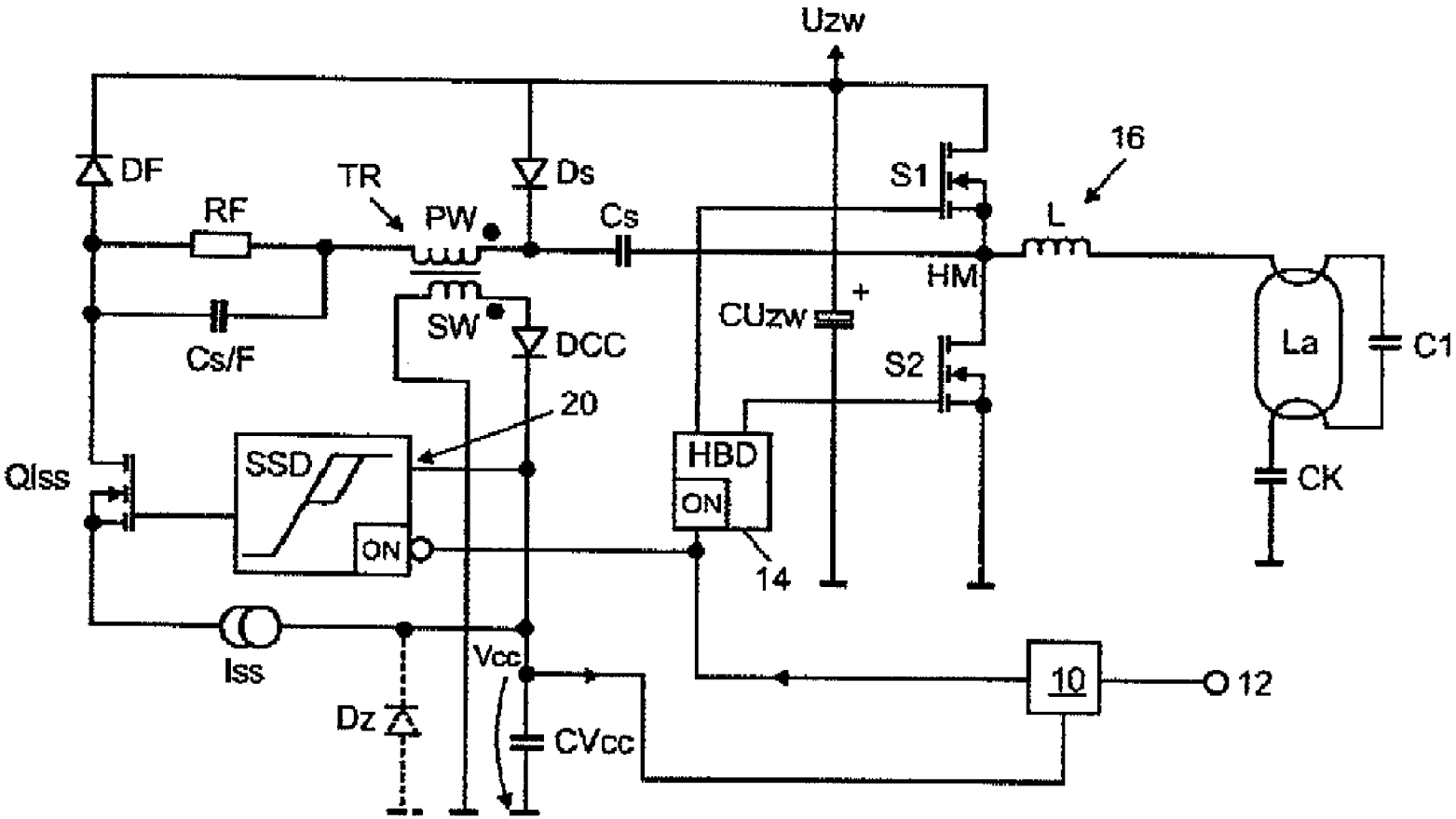
FIG. 4 shows a schematic illustration of a third exemplary embodiment of a circuit arrangement according to the invention for operating at least one discharge lamp.

The reference symbols introduced with reference to FIG. 1 are used further for identical and similar components for the embodiments illustrated in FIGS. 2 to 4. For this reason, details will substantially be given below regarding the differences from the circuit arrangement in FIG. 1.

The embodiment illustrated in FIG. 2 for a circuit arrangement according to the invention furthermore has the operational supply circuit 18 known from FIG. 1 for the controller 10. In order to reduce the standby losses when the half-bridge driver 14 is switched off, however, said circuit arrangement comprises a transformer TR, whose primary winding PW is arranged in series with the nonreactive resistor $R_F$. When the switch $Q_{ISS}$ enters the on state as a result of corresponding driving by the two-state controller SSD, a current from the intermediate circuit voltage $U_{ZW}$ flows through the primary winding PW and the nonreactive resistor $R_F$ via the switch $Q_{ISS}$ and the current source ISS in order to charge the capacitor $C_{VCC}$. In the off state of the switch $Q_{IDD}$, the primary winding PW can freewheel via the nonreactive resistor $R_F$ and a diode $D_F$. The secondary winding SW feeds, via a diode $D_{CC}$, the capacitor $C_{VCC}$, at which the auxiliary voltage $V_{CC}$ is provided. The freewheeling diode $D_F$, with the resistor $R_F$, ensures the demagnetization of the transformer TR.

As soon as the output circuit 16 is brought to a stop by a corresponding signal at the interface 12 and therefore at the half-bridge driver 14, the standby operating mode is active and the two-state controller SSD is activated. If the two-state controller SSD, by sensing its input 20, establishes that the auxiliary voltage $V_{CC}$ has fallen below the lower threshold of the two-state controller SSD, the current source ISS is switched on via the switch $Q_{ISS}$. Thus, a current flows via the primary winding PW and thus also, transformed by the transformation ratio, current from the secondary winding SW via the diode $D_{CC}$ into the capacitor $C_{VCC}$. As a result, the voltage $V_{CC}$ at the capacitor $C_{VCC}$ increases. As soon as the voltage $V_{CC}$ reaches the upper threshold of the two-state controller SSD, the current source ISS is switched off via $Q_{ISS}$. The primary energy stored in the transformer is drained via the resistor $R_F$ and the freewheeling diode $D_F$.

The embodiments of circuit arrangements according to the invention shown in FIG. 3 and FIG. 4 do not require a separate operational supply circuit for the controller 10, i.e. the controller 10 is supplied with voltage via the transformer TR, even during normal operation, if the output circuit 16 is in operation. For this purpose, a capacitor $C_s$ is coupled between the half-bridge center point HM on one side and the diode $D_F$ and the primary winding PW of the transformer TR on the other side. A capacitor $C_{S/F}$ is connected in parallel with the resistor $R_F$. The output circuit 16 is activated, and at the same time the two-state controller SSD is deactivated, via the interface 12. Thus, the standby auxiliary voltage generation, see in this regard the embodiments relating to FIG. 2, is shut down. The switch $Q_{ISS}$ isolates the current source ISS from the auxiliary voltage $V_{CC}$. The inverter which comprises the switches S1 and S2 switches the potential at the half-bridge center point HM back and forth alternately between $U_{ZW}$ and ground at a predetermined frequency.

Step 1: the voltage at the half-bridge center point HM of the output circuit 16 decreases from the intermediate circuit voltage $U_{ZW}$ to ground:

In this case, the capacitor $C_S$ is charged to the intermediate circuit voltage $U_{ZW}$ via the primary winding PW, the parallel circuit comprising the nonreactive resistor $R_F$ and the capacitor $C_{S/F}$ and via the switch S2. This takes place at a time constant which results from the nonreactive resistor $R_F$, the capacitor $C_{S/F}$ and the transformed load at the terminal at which the auxiliary voltage $V_{CC}$ is provided for the controller 10. In this charging operation, the secondary winding SW of the transformer TR charges the capacitor $C_{VCC}$ via the diode $D_{CC}$.

The capacitor $C_S$, the transformation ratio ü of the transformer TR and the components $C_{S/F}$ and $R_F$ can be dimensioned in such a way as to optimize and set the transmitted energy.

In this case, even low capacitance values for the capacitor $C_S$ are sufficient for generating an auxiliary voltage with a sufficient power. In an exemplary embodiment, the capacitance of the capacitor $C_S$ was equal to 150 pF, the transformation ratio ü of the transformer TR was equal to 10, the resistance of the nonreactive resistor $R_F$ was equal to 5.6 kΩ and the capacitance of the capacitor $C_{S/F}$ was 6.8 nF. Thus, an auxiliary voltage of $V_{CC}$ equal 15 V could be generated which could be subjected to 30 mA.

In order to protect the auxiliary voltage $V_{CC}$ against overvoltage, a zener diode $D_Z$ can be provided, as is illustrated by dashed lines.

Step 2: the voltage at the half-bridge center point HM of the output circuit 16 increases from ground to the intermediate circuit voltage $U_{ZW}$:

In this case, the capacitor $C_S$ is discharged via the first switch S1 and the diode $D_F$. It is therefore available for the next falling edge again for feeding in a charging current.

As a result of the use of a transformer TR, the capacitor $C_S$ can be given very small dimensions, for example can have a capacitance from 100 to 150 pF.

The embodiment of a circuit arrangement according to the invention illustrated in FIG. 4 is a variant of that illustrated in FIG. 3. In this case, the capacitor $C_S$ is charged via the diode $D_S$ and the switch S2, however. Energy is transmitted in this case during the discharging operation of the capacitor $C_S$, which takes place via the switch S1, the primary winding PW of the transformer TR, the parallel circuit comprising the nonreactive resistor $R_F$ and the capacitor $C_{S/F}$ and the diode $D_F$. The charging energy can be set via the transformation ratio ü of the transformer TR and the time constant which is effective during the respective charging operation.

The time constant is in particular selected such that full recharging of the capacitor $C_S$ is made possible for the generation of a maximum current-time integral through the primary winding PW.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

Additionally, please cancel the originally-filed Abstract of the Disclosure, and add the accompanying new Abstract of the Disclosure which appears on a separate sheet in the Appendix.

The invention claimed is:

1. A circuit arrangement for operating at least one discharge lamp, comprising:

a first and a second input terminal for connecting a supply voltage;

an inverter, which comprises at least one first switch and one second switch, which are coupled in series between the first and the second input terminal and between which a bridge center point is defined;

a drive circuit for at least the first switch and the second switch with an input for receiving a control signal;

an apparatus for generating an auxiliary voltage, the apparatus comprising:

a first capacitor;

a terminal for the provision of the auxiliary voltage, which terminal is coupled to a reference potential via the first capacitor;

a two-state controller with a first input to which the control signal in inverted form is coupled, a second input, which is coupled to the terminal for the provision of the auxiliary voltage, and an output;

a switch with a control electrode, a working electrode and a reference electrode, the control electrode being coupled to the output of the two-state controller, the working electrode being coupled to the terminal for the provision of the auxiliary voltage; and a nonreactive resistor;

wherein the apparatus for generating the auxiliary voltage furthermore comprises a transformer with a primary winding and a secondary winding, the transformer being coupled to the first and the second input terminal, the terminal for the provision of the auxiliary voltage and the switch in such a way that a current through the switch results in a current through the primary winding, in a current through the secondary winding and therefore in charging of the first capacitor.

2. The circuit arrangement as claimed in claim 1, wherein the primary winding and the nonreactive resistor are connected in series, and this series circuit is coupled between the reference electrode of the switch and the first input terminal; the apparatus for generating the auxiliary voltage furthermore comprising:

a first diode, which is connected in parallel with the series circuit comprising the primary winding and the nonreactive resistor and is arranged such that it enables freewheeling of the current through the primary winding; and a second diode, which is connected in series with the secondary winding, the series circuit comprising the secondary winding and the second diode being coupled between the reference potential and the terminal for the provision of the auxiliary voltage.

3. The circuit arrangement as claimed in claim 1, wherein a zener diode is connected in parallel with the first capacitor.

4. The circuit arrangement as claimed in claim 1, wherein a current source is coupled between the working electrode of the switch and the terminal for the provision of the auxiliary voltage.

5. The circuit arrangement as claimed in claim 4, wherein the current source is realized by a nonreactive resistor.

6. The circuit arrangement as claimed in claim 1, wherein the apparatus for generating an auxiliary voltage furthermore comprises a second capacitor with a first and a second terminal, which is coupled to the bridge center point and the primary winding in such a way that a capacitive displacement current can flow through the primary winding.

7. The circuit arrangement as claimed in claim 6, wherein the first terminal of the second capacitor is coupled to the bridge center point, and in that the second terminal of the second capacitor is coupled to the reference electrode of the switch.

8. The circuit arrangement as claimed in claim 6, wherein the apparatus for generating an auxiliary voltage furthermore comprises a third diode, the primary winding being coupled to the first input terminal via the third diode, the third diode being arranged to allow a current flow from the first input terminal to the primary winding, the node between the primary winding and the third diode being coupled to the second terminal of the second capacitor.

9. The circuit arrangement as claimed in claim 6, wherein the apparatus for generating an auxiliary voltage furthermore comprises a third capacitor, which is connected in parallel with the nonreactive resistor.

10. A method for generating an auxiliary voltage in a circuit arrangement for operating at least one discharge lamp, the circuit arrangement having a first and a second input terminal for connecting a supply voltage, an inverter, which comprises at least one first switch and one second switch, which are coupled in series between the first and the second input terminal and between which a bridge center point is defined, a drive circuit for at least the first switch and the second switch, with an input for receiving a control signal, and an apparatus for generating an auxiliary voltage, which comprises a first capacitor, and a terminal for the provision of the auxiliary voltage, which terminal is coupled to a reference potential via the first capacitor, a two-state controller with a first input to which the control signal in inverted form is coupled, a second input, which is coupled to the terminal for the provision of the auxiliary voltage, and an output, a switch with a control electrode, a working electrode and a reference electrode, the control electrode being coupled to the output of the two-state controller, the working electrode being coupled to the terminal for the provision of the auxiliary voltage, and a nonreactive resistor;

the method comprising:

a) generating a control signal such that the switch is switched into the on state by the two-state controller;

b) coupling of a primary winding of a transformer to the switch in such a way that, as a result of the switch which has been switched into the on state, a current flows through the primary winding of a transformer;

c) as a result of the current through the primary winding of the transformer: generating a current through the secondary winding of the transformer;

d) coupling of the current through the secondary winding to the first capacitor.

* * * * *